US010381720B2

(12) United States Patent
Manzi et al.

(10) Patent No.: US 10,381,720 B2
(45) Date of Patent: Aug. 13, 2019

(54) RADIO FREQUENCY IDENTIFICATION (RFID) INTEGRATED CIRCUIT (IC) AND MATCHING NETWORK/ANTENNA EMBEDDED IN SURFACE MOUNT DEVICES (SMD)

(75) Inventors: Giuliano Manzi, Graz (AT); Gerald Wiednig, Stainz (AT)

(73) Assignee: NXP B.V., Eindhoven (NL)

( * ) Notice: Subject to any disclaimer, the term of this patent is extended or adjusted under 35 U.S.C. 154(b) by 790 days.

(21) Appl. No.: 12/963,337

(22) Filed: Dec. 8, 2010

(65) Prior Publication Data

US 2012/0146768 A1 Jun. 14, 2012

(51) Int. Cl.

| | |
|---|---|
| ***H01Q 1/22*** | (2006.01) |
| ***H01Q 1/38*** | (2006.01) |
| ***H01Q 7/00*** | (2006.01) |
| ***H01Q 21/30*** | (2006.01) |

(52) U.S. Cl.

CPC ..... *H01Q 1/38* (2013.01); *H01Q 1/2225* (2013.01); *H01Q 1/2283* (2013.01); *H01Q 7/00* (2013.01); *H01Q 21/30* (2013.01); *Y10T 29/4902* (2015.01)

(58) Field of Classification Search

CPC ..... H01L 23/538; H01L 23/5383; H01L 23/5389; H01L 23/5226; H01L 23/5227; H01L 23/645; H01L 24/24; H01L 24/45; H01L 24/82; H01L 24/84; H01L 28/10; H01L 2223/6611; H01L 2223/6616; H01L 2223/6677; H01L 2924/19102; H01L 2924/19103; H01L 2924/19104; G06K 19/07745; G06K 19/0723; G06K 19/07718; G06K 19/07722; G06K 19/07749; G06K 19/0775; G06K 19/07773; G06K 19/07777; G06K 19/07779; H01Q 1/2283; H01Q 1/38

USPC ..... 340/572.1–572.9, 10.1–10.6; 235/492

See application file for complete search history.

(56) References Cited

U.S. PATENT DOCUMENTS

| | | | | |
|---|---|---|---|---|
| 5,454,160 | A * | 10/1995 | Nickel | 29/840 |
| 5,831,348 | A * | 11/1998 | Nishizawa | 307/104 |
| 5,994,766 | A * | 11/1999 | Shenoy et al. | 257/659 |
| 5,995,006 | A * | 11/1999 | Walsh | 340/572.7 |
| 6,049,461 | A | 4/2000 | Haghiri-Tehrani et al. | |
| 6,104,281 | A | 8/2000 | Heinrich et al. | |
| 6,118,379 | A | 9/2000 | Kodukula et al. | |
| 6,388,202 | B1 * | 5/2002 | Swirbel et al. | 174/261 |
| 6,614,093 | B2 | 9/2003 | Ott et al. | |
| 7,155,178 | B2 * | 12/2006 | Chang et al. | 455/101 |
| 7,463,199 | B2 | 12/2008 | Soler Castany et al. | |
| 7,564,359 | B2 * | 7/2009 | Koh et al. | 340/572.8 |

(Continued)

FOREIGN PATENT DOCUMENTS

| | | |
|---|---|---|
| CN | 101814157 A | 8/2010 |
| EP | 2023275 A1 | 2/2009 |
| FR | 2 904 453 A1 | 2/2008 |

OTHER PUBLICATIONS

European Search Report, EP11192313, dated Apr. 10, 2012.

*Primary Examiner* — Ryan W Sherwin

(57) ABSTRACT

A matching network is integrated into a multilayer surface mount device containing an RFID integrated circuit to provide both an antenna and a matching network for the RFID integrated circuit in the ultra high frequency regime. The surface mount device may be mounted on a printed circuit board to provide RF and RFID functionality to the printed circuit board.

18 Claims, 11 Drawing Sheets

(56) References Cited

U.S. PATENT DOCUMENTS

| | | | | |
|---|---|---|---|---|
| 7,571,115 | B2 | 8/2009 | Forster et al. | |
| 7,750,864 | B2 | 7/2010 | Hilgers | |
| 7,830,311 | B2 * | 11/2010 | Kataya et al. | 343/700 MS |
| 7,963,451 | B2 | 6/2011 | Kawai | |
| 7,990,337 | B2 | 8/2011 | Kato et al. | |
| 8,310,035 | B2 * | 11/2012 | Sasaki | 257/676 |
| 8,525,646 | B2 | 9/2013 | Tamm et al. | |
| 2004/0212038 | A1 | 10/2004 | Ott et al. | |
| 2004/0217865 | A1 | 11/2004 | Turner | |
| 2006/0043198 | A1 | 3/2006 | Forster | |
| 2006/0044769 | A1 | 3/2006 | Forster et al. | |
| 2006/0057763 | A1 | 3/2006 | Teo et al. | |
| 2006/0109119 | A1 * | 5/2006 | Burr et al. | 340/572.1 |
| 2007/0171078 | A1 | 7/2007 | Cotton | |
| 2008/0023810 | A1 | 1/2008 | Yamazaki et al. | |
| 2008/0054493 | A1 * | 3/2008 | Leddige et al. | 257/786 |
| 2008/0055045 | A1 | 3/2008 | Swan et al. | |
| 2008/0107878 | A1 | 5/2008 | Irving et al. | |
| 2008/0284656 | A1 | 11/2008 | Petropoulos | |
| 2009/0021446 | A1 * | 1/2009 | Kataya et al. | 343/860 |
| 2009/0058649 | A1 | 3/2009 | Tuttle | |
| 2009/0128289 | A1 | 5/2009 | Rossman | |
| 2009/0262041 | A1 * | 10/2009 | Ikemoto | G06K 19/07749 343/860 |
| 2009/0266900 | A1 * | 10/2009 | Ikemoto et al. | 235/492 |
| 2009/0277966 | A1 | 11/2009 | Kato et al. | |
| 2010/0156563 | A1 | 6/2010 | Dokai et al. | |
| 2010/0302013 | A1 * | 12/2010 | Kato et al. | 340/10.51 |
| 2011/0043338 | A1 * | 2/2011 | Kato et al. | 340/10.1 |
| 2012/0104103 | A1 * | 5/2012 | Manzi | 235/492 |
| 2012/0146768 | A1 | 6/2012 | Manzi et al. | |

* cited by examiner

RADIO FREQUENCY IDENTIFICATION (RFID) INTEGRATED CIRCUIT (IC) AND MATCHING NETWORK/ANTENNA EMBEDDED IN SURFACE MOUNT DEVICES (SMD)

BACKGROUND

RFID tag and reader systems may operate over a wide range of frequencies, including low-frequency (LF) applications, high-frequency (HF) applications, and ultra-high-frequency applications (UHF). LF applications typically operate in the range from about 125-148.5 kHz. HF applications typically operate at 13.56 MHz. UHF applications typically operate from 300 MHz to 3 GHz. The "read range" of an RFID tag and reader system is typically defined as the distance from which a reader can communicate with an RFID tag. Passive LF and HF applications offer relatively short read ranges, often requiring the RFID tag to be within about 2.5 cm to 30 cm of a reader for successful communication. Passive UHF applications typically offer longer read ranges, allowing RFID tags to be within about 2 to 12 meters or more of a reader for successful communication. However, various environmental factors can detune an RFID tag, thus modifying the operating frequency and potentially affecting the received power and the read range of the RFID tag. RFID tags in the presence of metals and liquids may experience detuning due to absorption or parasitic capacitance provided by these materials. Detuning can also be caused by the capacitance and inductance spread due to processing and/or packaging.

The electronics equipment industry require high accuracy tracking of products in the production process. Furthermore, they need to manage the products lifecycle precisely and efficiently. Hence, the electronics equipment industry need to deal with everything from production, distribution, consumption and to products disposal. To achieve a system able to track a product throughout its lifecycle requires a way to easily record and read information, such as production process history.

Although barcodes are the current standard for individual identification of products, they currently offer no way of recording additional information. RFID is currently the only solution that allows the storing of information related to the products lifecycle directly on the product.

Common RFID solutions based on RFID tags cannot be directly applied to the products of the electronics industry (i.e. printed circuit boards) due to the processes used in the printed circuit board (PCB) manufacturing (i.e. reflow process, heat process and chemicals process). These issues can be solved by using a dedicated solution that can be well integrated in the PCB manufacturing design and using dedicated IC packaging.

DETAILED DESCRIPTION

In accordance with the invention, printed circuit board tracking and identification are enabled along with electronic equipment tracking and identification. Distribution history and electronic equipment lifecycle and process history may be tracked using surface mount device (SMD) based component 115 having embedded into it UHF-RFID IC 120 and multilayered inductive coil 225. (see FIGS. 1 and 2).

Figure 1:
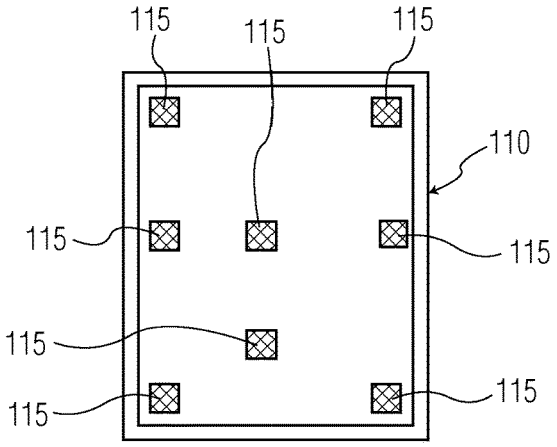
FIG. 1 shows possible locations on a printed circuit board for a surface mount device to be mounted in accordance with the invention.

SMD based component 115 can be placed on PCB 110 in accordance with standard industrial production processes typically used in PCB manufacturing for SMD and typically occupying a small footprint on PCB 110. FIG. 1 shows exemplary areas on PCB 110 where SMD component 115 may be located in embodiments in accordance with the invention while not requiring a ground clearance area and typically occupying an area in the range of about 10 $mm^2$ to about 16 $mm^2$ on PCB 110. Ground clearance is not required because multilayered inductive coil 225 inside SMD based component 115 functions as a matching network so it is not necessary to remove the ground layer from PCB 110 in the vicinity of where SMD 115 is placed on PCB 110. The radio frequency port of UHF-RFID IC 120 typically does not require any electrical connection to the PCB reference ground plane or any external antenna to function because of multilayered inductive coil 225 inside SMD 115 functioning as both an antenna and a matching network for short ranges on the order of about 0.5 cm. In embodiments in accordance with the invention where no special functionality from UHF-RFID IC 120 is required (e.g. battery assisted mode operation, I2C bus or data bus functionality, direct access to UHF-RFID IC 120 memory by another device located on PCB 110 or elsewhere) and there is no need to interface SMD component 115 with any component on PCB 110, SMD component 115 is typically placed along the perimeter of PCB 110.

I2C bus, data bus or direct memory access to UHF-RFID IC 120 memory by another device on PCB 110 may be implemented in accordance with the invention. For example, in an embodiment in accordance with the invention, UHF-RFID IC 120 may be connected by an I2C bus or data bus to a central processing unit (CPU), a digital signal processor (DSP) or any other programmable device located on PCB 110. The radio frequency interface provided by UHF-RFID IC 120 in SMD component 115 on PCB 110 may be used to transmit commands or instructions directly to the programmable device on PCB 110. In particular, a programmable device on PCB 110 may need to be programmed and activated prior to first use which may be accomplished by using the radio frequency interface. Also, a programmable device on PCB 110 connected to UHF-RFID IC 120 in SMD component 115 can check that PCB 110 may be enabled for first use by communicating with interrogator 210 (see FIG. 2) using the radio frequency interface or can check the memory of UHF-RFID IC 120 for activation information previously stored there during communication with interrogator 210.

Figure 2:
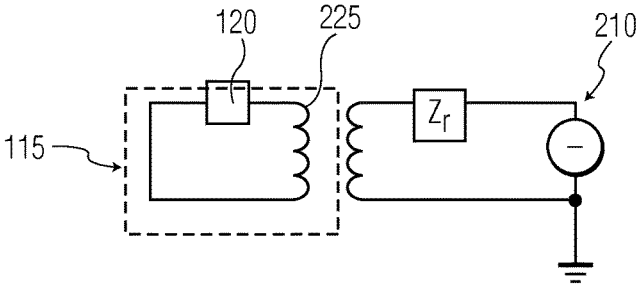
FIG. 2 shows a schematic of an RFID system in accordance with the invention.

In an embodiment in accordance with the invention, SMD component 115 has embedded into it UHF-RFID IC 120 and multilayered inductive coil 225 which typically acts as both an antenna and matching network for embedded UHF-RFID IC 120 as shown for the system in accordance with the invention in FIG. 2. Multilayered inductive coil 225 has an impedance of about 4+150 j Ω at about 915 MHz and is matched to the impedance of UHF-RFID IC 120 which is about 15-150 jΩ to optimize the power transfer between multilayered inductive coil 225 and UHF-RFID IC 120. The multilayered structure of multilayered inductive coil 225 may be implemented using typical multilayered PCB production processes such as, for example, foil pressing or core pressing. Due to the multilayer coil nature of multilayered inductive coil 225, multilayered inductive coil 225 also functions as an impedance transformer for the electromagnetic plane waves from interrogator 210 having an equivalent input impedance Zr.

For ranges less than about 1 cm between SMD component 115 and interrogator 210 (see FIG. 2), no electrical contact between SMD component 115 and PCB 110 is necessary. Multilayered inductive coil 225 is electrically connected in parallel with UHF-RFID IC 120. UHF-RFID IC 120 may be activated for identification purposes by the power received by multilayered inductive coil 225 from the magnetic field of the propagating electromagnetic waves from interrogator 210 which generates a current flowing in multilayer coil inductor 225 that activates UHF-RFID IC 120. Multilayered inductive coil 225 provides impedance matching and a short range antenna function that can accommodate worldwide UHF bands in the range of about 860 MHz to about 965 MHz in compliance with the EPC Global C1 G2 standard. For extended ranges of up to about 2 meters, SMD component 115 may be attached to an external antenna, such as a pair of traces on PCB 110 or to an electrical surface such as the ground plane of PCB 110, for example.

For the system shown in FIG. 2, SMD component 115 is typically mounted on printed circuit board 110 that is typically part of a product. Interrogator 210 may obtain information related to the product's lifecycle or other relevant information related to the product by interrogating UHF-RFID IC 120 in accordance with the invention.

Figure 3:
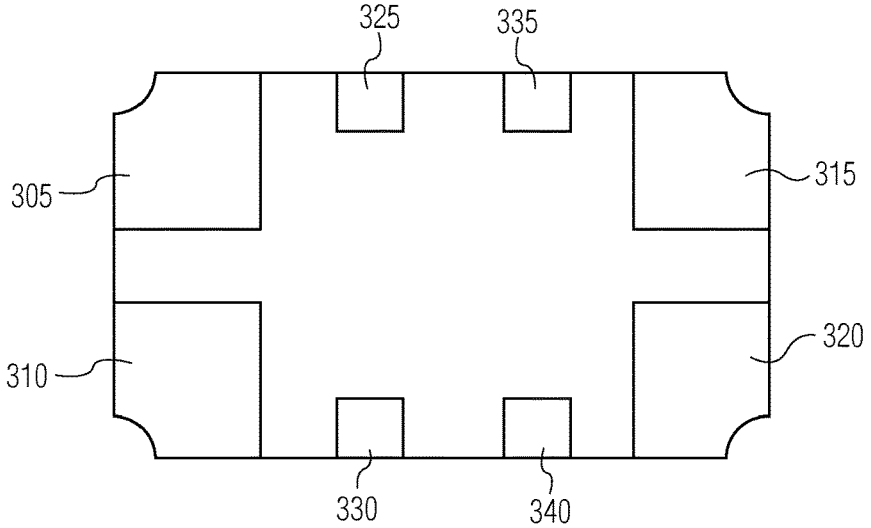
FIG. 3 shows the footprint of a surface mount device in accordance with the invention.

FIG. 3 shows an exemplary pad layout configuration for SMD component 115 in accordance with the invention. Pads 305, 310, 315 and 320 on bottom layer 300 of SMD component 115 provide for physical connection to PCB 110. Dedicated pads 325 and 330 allow for connections to an I2C bus, data bus or to a battery to SMD component 115 using traces on PCB 110. Dedicated pads 335 and 340 allow for electrical connections to an external antenna structure for added range. The external antenna structure may, for example, be a pair of traces on the perimeter of PCB 110 or the ground plane of PCB 110. In the event of a ground plane connection, only one pad, for example pad 340 is electrically connected directly to the ground plane of PCB 110. Pad 335 is then electrically connected to a short trace on the surface of PCB 110 or to a passive capacitance component electrically connected to the ground plane of PCB 110 or isolated from other components on PCB 110.

SMD component 115 is typically built by laminating together a multilayer structure including UHF-RFID IC 120 using processes typically used for making multilayer PCBs. The material typically used for the different layers is a high dielectric material such as TACONIC CER-10®. CER-10 is an organic-ceramic Dk-10 (Dk stands for dielectric constant) laminate, based on a woven glass reinforcement available from TACONIC Advanced Dielectric Division.

Figure 4A:
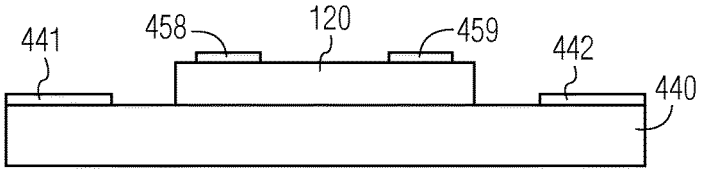
FIGS. 4*a*-4*h* show the steps for embedding a UHF-RFID IC into a surface mount device in accordance with the invention.
Figure 4B:
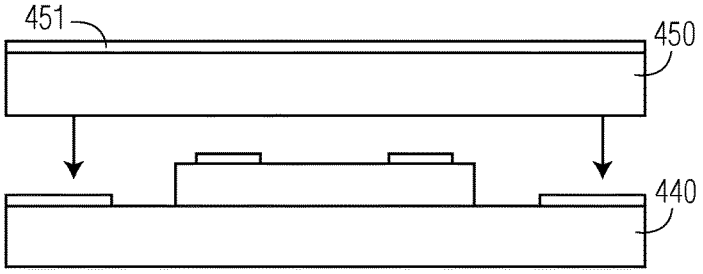
Figure 4C:
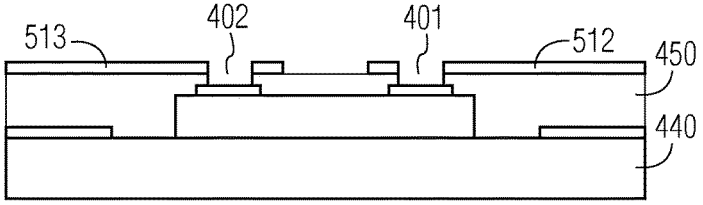
Figure 4D:
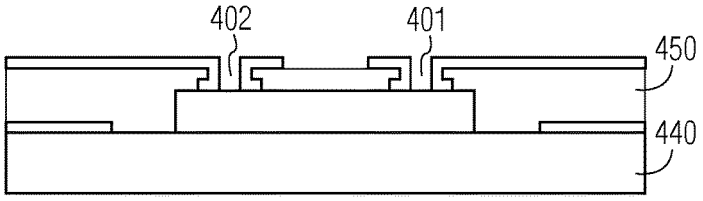
Figure 4E:
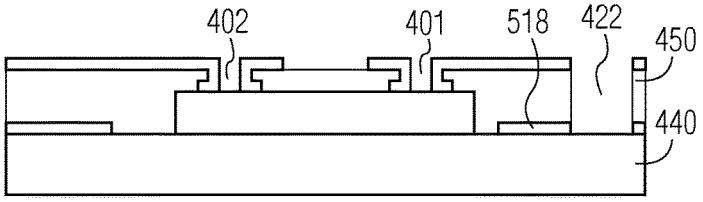
Figure 4F:
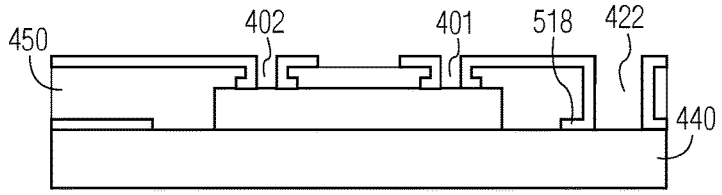
Figure 4G:
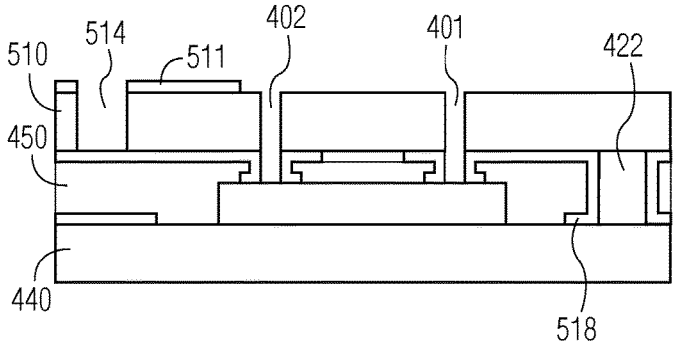
Figure 4H:
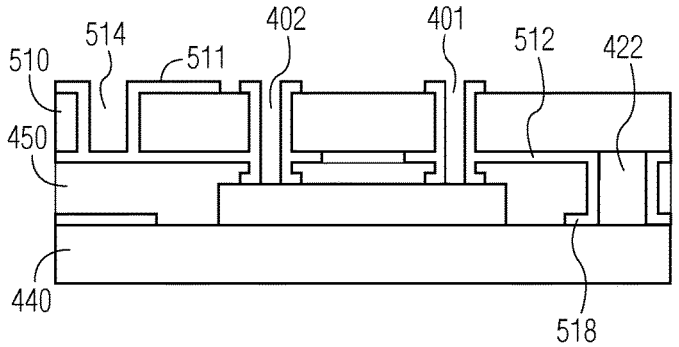

FIGS. 4*a-h* show the embedding and laminating process for embedding UHF-RFID IC 120 into multilayer SMD component 115 in an embodiment in accordance with the invention. FIG. 4*a* shows the die attach of UHF-RFID IC 120 to dielectric layer 440 of the multilayer SMD component 115. Dielectric layer 440 has two resin coated copper film pads 441 and 442 for laminating dielectric layer 440 to dielectric layer 450 and providing contact pads for microvia laser drilling as shown in FIG. 4*b*. The top of dielectric layer 450 is covered by resin coated copper film 451 to allow lamination of a subsequent layer and creation of traces. After dielectric layers 440 and 450 have been laminated together, traces 512 and 513 are formed in resin coated copper film 451 and laser drilling is typically used to create microvias 401 and 402 as shown in FIG. 4*c*. Microvias 401 and 402 provide access to die pads 459 and 458, respectively and metallization of microvias 401 and 402 is performed in FIG. 4*d*, electrically connecting die pads 459 and 458 of UHF-RFID IC 120 to traces 512 and 513, respectively. FIG. 4*e* shows formation of via 422 in layer 450. FIG. 4*f* shows metallization of via 422 to electrically connect trace 512 to trace 518. In FIG. 4*g*, dielectric layer 510 is laminated to dielectric layer 450 and trace 511 and via 514 along with microvias 401 and 402 are formed on dielectric layer 510. In FIG. 4*h*, metallization of via 514 is performed to electrically connect trace 511 to trace 513 along with the metallization of microvias 401 and 402 in dielectric layer 510.

Figure 5A:
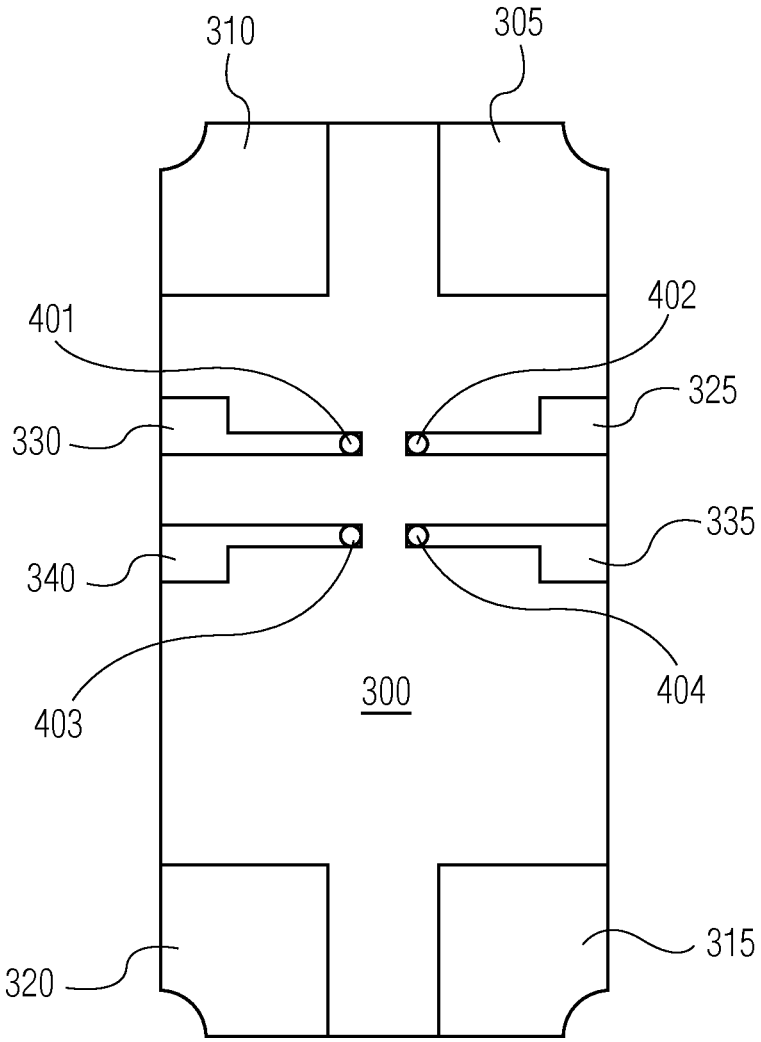
FIGS. 5*a*-5*g* show the dielectric layers and trace layout of an embodiment in accordance with the invention.
Figure 5B:
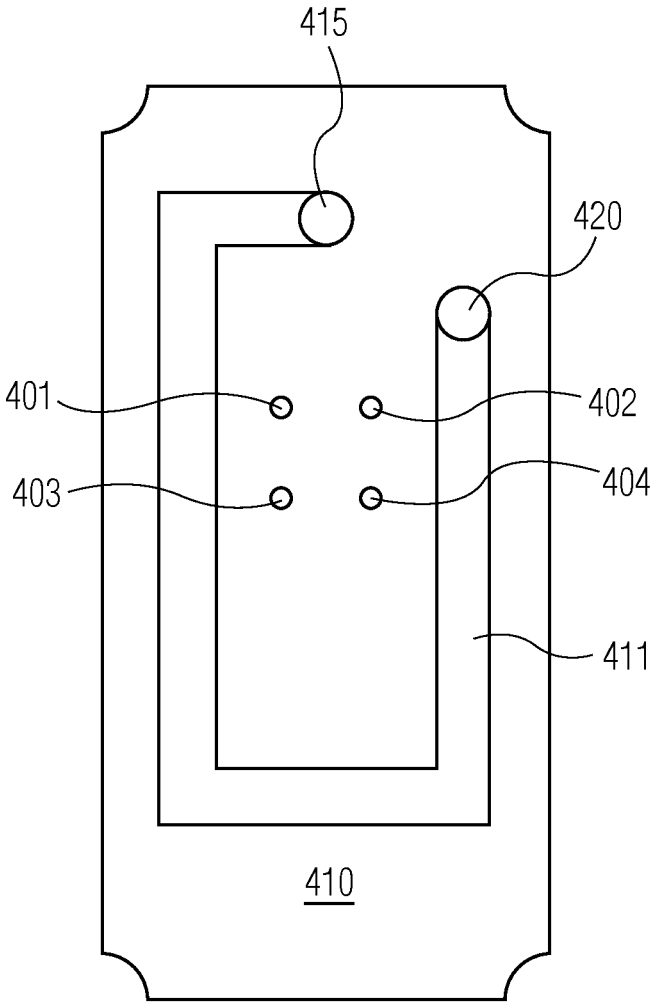
Figure 5C:
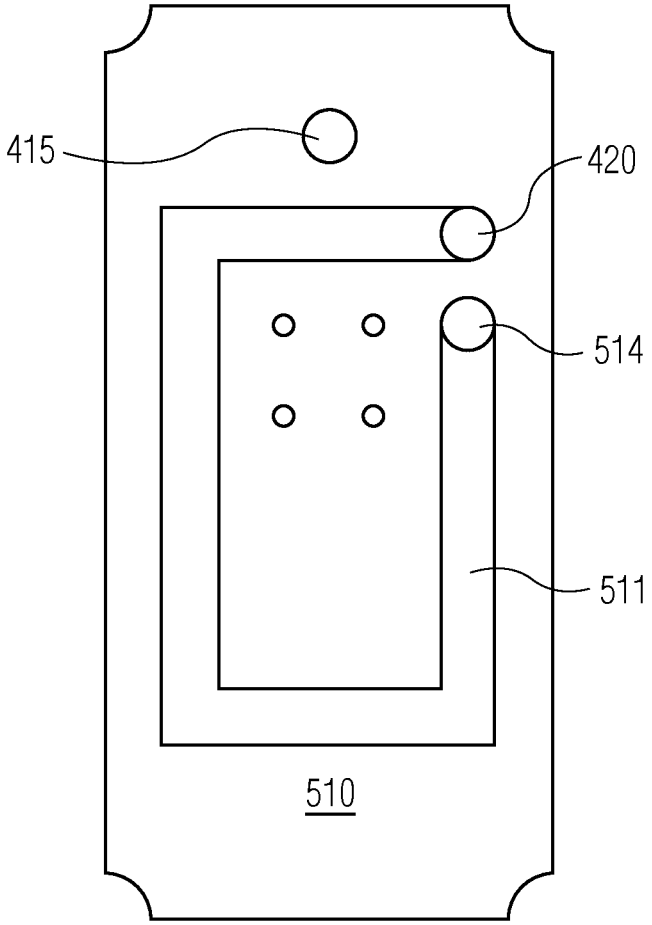
Figure 5D:
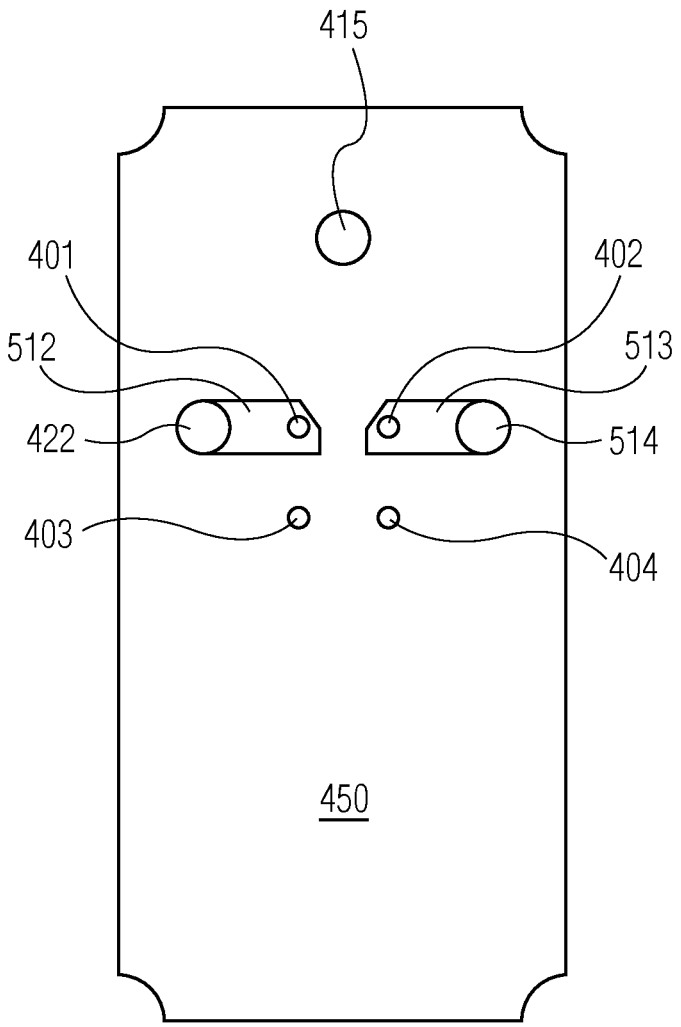
Figure 5E:
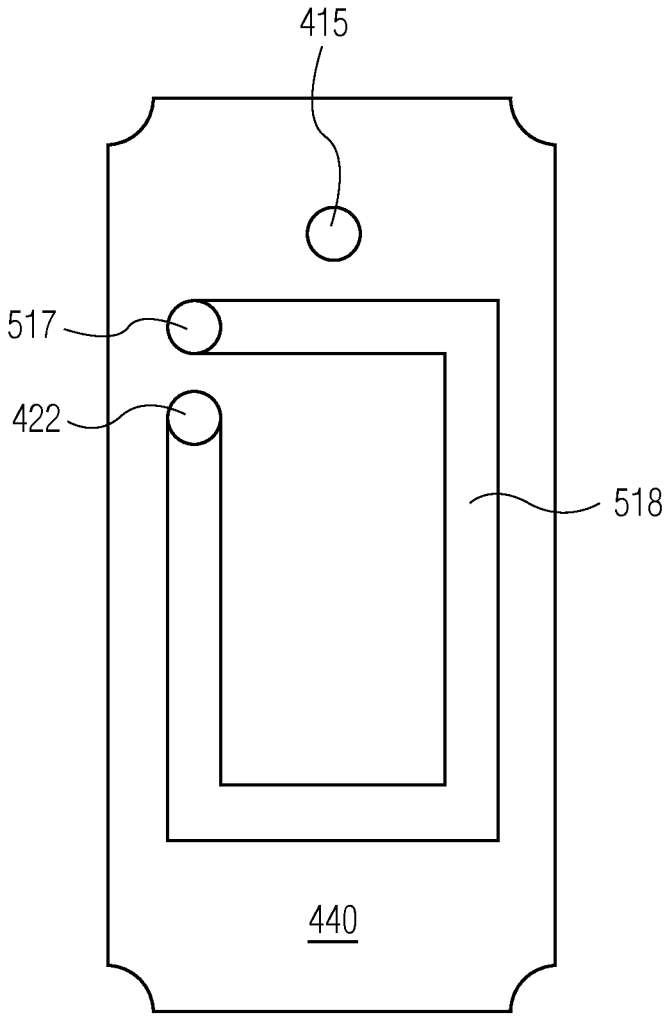
Figure 5F:
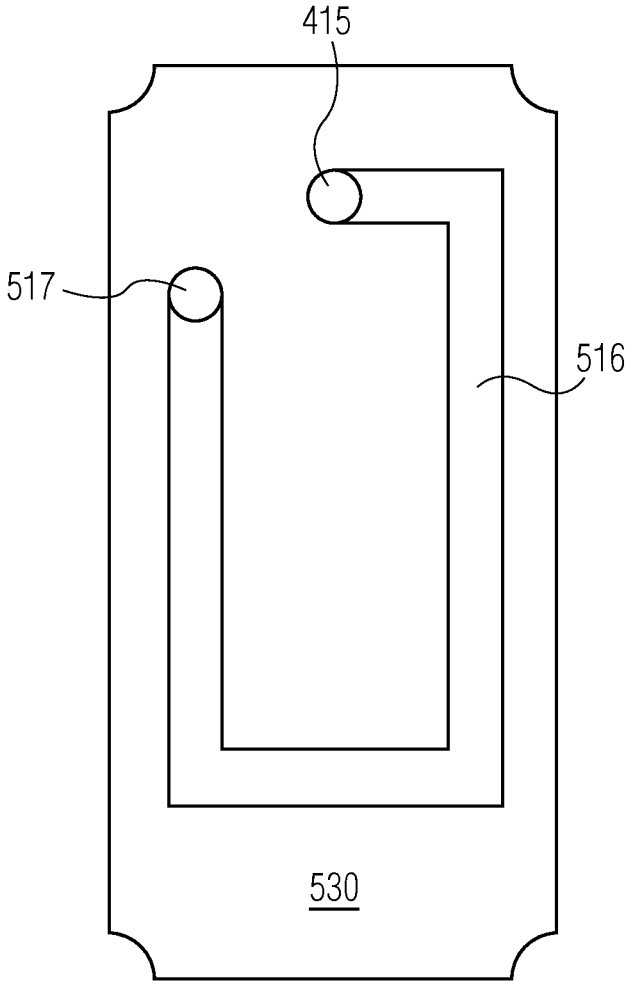
Figure 5G:
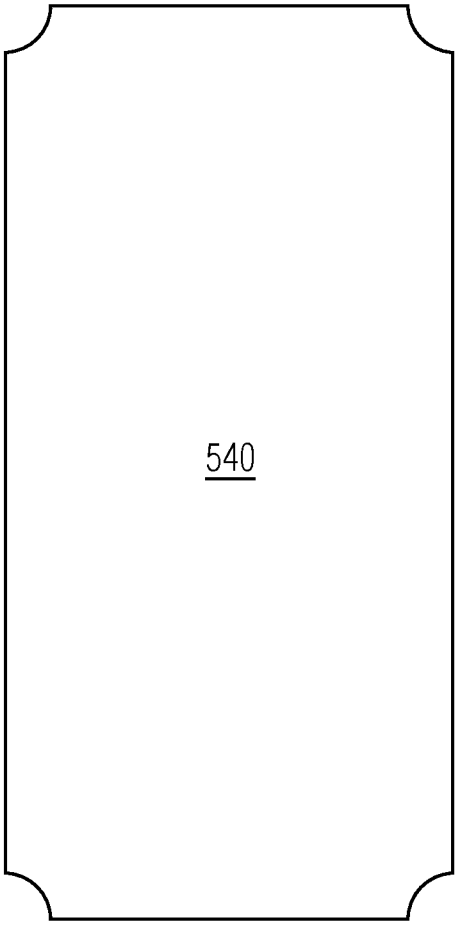

In accordance with an exemplary embodiment in accordance with the invention, seven dielectric layers are used to create SMD component 115. More or less layers may be used as required for the specific application in accordance with the invention. FIGS. 5*a*-5*g* show the layout of each of the seven dielectric layers of SMD component 115. Note that bottom layer 300 is shown in top view through the dielectric layer (revealing the metallization on the bottom side). Traces 411, 511, 512, 513, 518, 516 shown in layers 410, 510, 450, 440, 530 in FIGS. 5*b*-5*f*, respectively, are electrically connected by vias 415, 420, 514, 422, 514, 517 to form multilayered inductive coil 225. FIG. 5*a* shows the bottom layer 300 with pads 305, 310, 315 and 320 for physical connection to PCB 110. Note that in the two-dimensional views of FIGS. 5*b-f*, the vias and microvias are indicated where they electrically contact the respective traces Dedicated pads 335 and 340 allow for electrical connections to an I2C bus, data bus or to a battery to SMD component 115 using microvias 403 and 404 which electrically connect to dedicated pads 335 and 340, respectively. Dedicated pads 325 and 330 allow for electrical connections to an external antenna structure for added range using microvias 401 and 402 which electrically connect to dedicated pads 325 and 300, respectively. FIG. 5*b* shows layer 410 where trace 411 forms part of multilayered inductive coil 225. Via 420 electrically connects trace 411 in layer 410 to trace 511 in layer 510 as shown in FIG. 5*c*. Via 415 in FIG. 5*b* electrically connects to trace 411 in layer 410 and passes through layers 510, 450, 440 and 530 to electrically connect to trace 516 in layer 530 as shown in FIG. 5*f* so that traces 411 and 516 are electrically connected. Trace 511 in layer 510 is electrically connected to trace 513 in layer 450 by via 514 as shown in FIG. 5*d* so that traces 513, 511 and 411 are electrically connected. Via 514 electrically connects trace 511 in layer 510 to trace 513 in layer 450. Trace 513 is electrically connected to microvia 402 in layer 450. Trace 512 in layer 450 is electrically connected to microvia 401 and to via 422. Microvias 401 and 402 are electrically connected to antenna input pads for UHF-RFID IC 120. Microvias 403 and 405 are electrically connected to pads of UHF-RFID IC 120 that electrically connect to an I2C bus, data bus or to a battery. Via 422 electrically connects trace 512 in layer 450 to trace 518 in layer 440 shown in FIG. 5*e*. Layer 440 is the layer (see FIGS. 4*a-d*) where UHF-RFID IC 120 is attached. Via 517 in layer 440 electrically connects trace 518 to trace 516 in layer 530 as shown in FIG. 5*f* and trace 516 is electrically connected to via 415 to form multilayered inductive coil 225. Finally, layer 540 shown in FIG. 5*g* covers layer 530 to form the package for SMD component 115.

Figure 6:
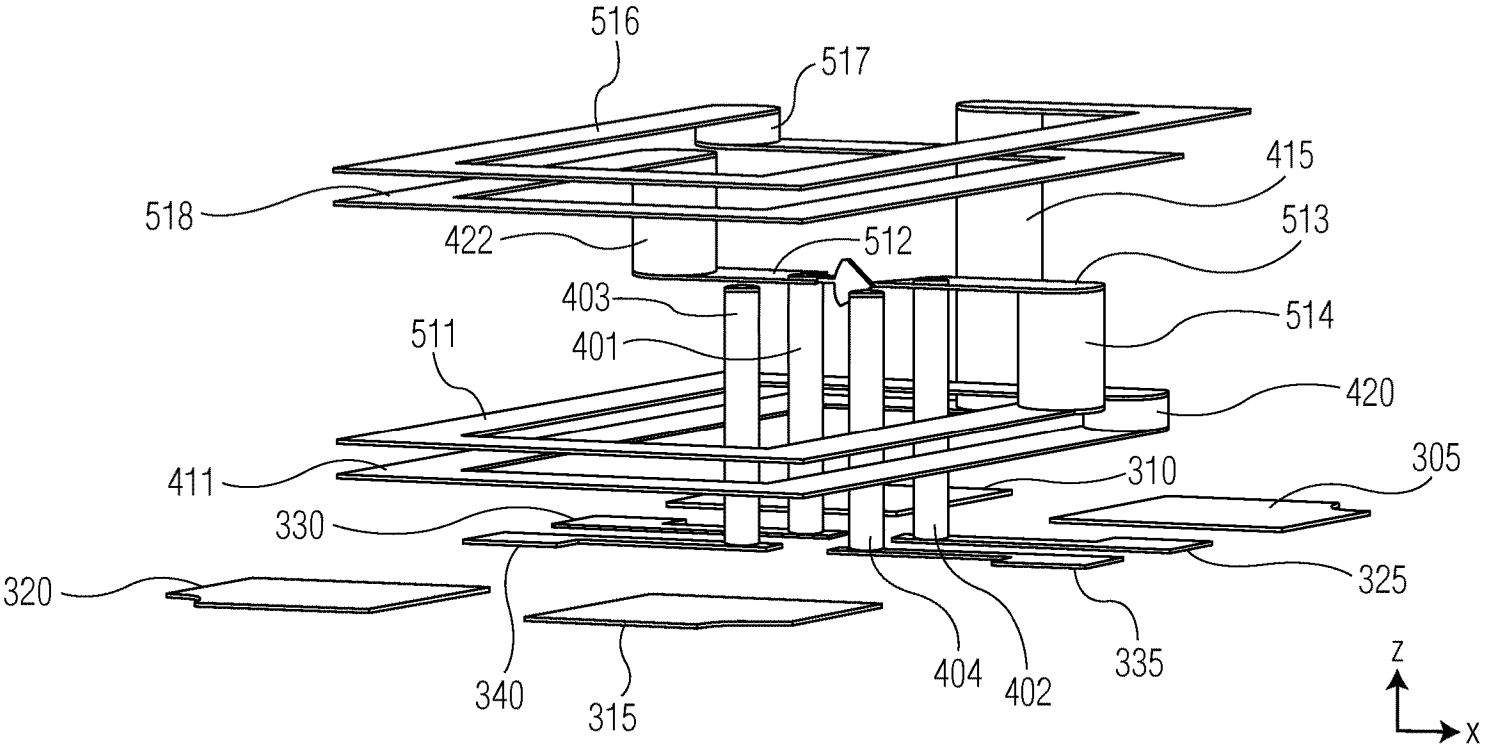
FIG. 6 shows a three-dimensional view of the vias, microvias, dedicated pads and traces of an embodiment in accordance with the invention.

FIG. 6 shows a three-dimensional view of the vias, microvias, dedicated pads and traces of SMD component 115 in an exemplary embodiment in accordance with the invention. Note that the dielectric layers are not shown for clarity in FIG. 6. Dedicated pads 335 and 340 allow for electrical connections to an I2C bus, data bus or to a battery to SMD component 115 using microvias 403 and 404 which electrically connect to dedicated pads 335 and 340, respectively. Dedicated pads 325 and 330 allow for electrical connections to an external antenna structure for added range using microvias 401 and 402 which electrically connect to dedicated pads 325 and 300, respectively. Trace 411 forms part of multilayered inductive coil 225. Via 420 electrically connects trace 411 to trace 511. Via 415 electrically connects trace 411 to trace 516. Trace 511 is electrically connected to trace 513 by via 514 so that traces 513, 511 and 411 are electrically connected. Via 514 electrically connects trace 511 to trace 513. Trace 513 is electrically connected to microvia 402. Trace 512 is electrically connected to microvia 401 and to via 422. Microvias 401 and 402 are electrically connected to antenna input pads for UHF-RFID IC 120 (not shown). Microvias 403 and 405 are electrically connected to pads of UHF-RFID IC 120 (not shown) that electrically connect to an I2C bus, data bus or to a battery. Via 422 electrically connects trace 512 to trace 518. Via 517 electrically connects trace 518 to trace 516 and trace 516 is electrically connected to via 415 to form multilayered inductive coil 225.

While the invention has been described in conjunction with specific embodiments, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

The invention claimed is:

1. A device comprising:

a printed circuit board (PCB); and a surface mount device (SMD) component that is surface mounted to a surface of the PCB, the SMD component including a multilayer surface mount structure of dielectric layers that are laminated together and an RFID (Radio Frequency Identification) integrated circuit embedded within the multilayer surface mount structure between dielectric layers that are laminated together and electrically coupled to a first end and to a second end of a multilayer inductive coil at respective pads of the RFID integrated circuit, wherein the RFID integrated circuit is embedded between a first dielectric layer that is laminated together to a second dielectric layer, the multilayer inductive coil including a plurality of traces that are vertically distributed within the multilayer surface mount structure between dielectric layers that are laminated together above and below the embedded RFID integrated circuit and electrically coupled together vertically by metalized vias to form the multilayer inductive coil for the RFID integrated circuit, wherein the plurality of traces above and below the embedded RFID integrated circuit and the metalized vias form an uninterrupted conductive path that travels above and below the embedded RFID integrated circuit from the first end to the second end of the multilayer inductive coil.

2. The device of claim 1 wherein the multilayer inductive coil is adapted for UHF (Ultra High Frequency) frequencies.

3. The device of claim 1 wherein the multilayer inductive coil forms a matching network for the RFID integrated circuit.

4. The device of claim 1 wherein the plurality of traces comprise copper.

5. The device of claim 1 wherein the multilayer inductive coil is electrically coupled to a pair of traces on the printed circuit board to form a dipole antenna for the RFID integrated circuit.

6. The device of claim 1 wherein the multilayer inductive coil is electrically coupled to a ground plane of the printed circuit board.

7. The device of claim 1 wherein the multilayer surface mount structure comprises two dielectric layers.

8. The device of claim 1 wherein the SMD component is adapted to receive power from an interrogator.

9. A system to track a product throughout its lifecycle comprising:

an interrogator; and a device as claimed in claim 1 that is part of the product such that the RFID (Radio Frequency Identification) integrated circuit can be interrogated by the interrogator to provide information about the product.

10. The device of claim 1 wherein the SMD component includes internal microvias that electrically connect pads of the RFID integrated circuit to the external pads on the bottom surface of the SMD component that are connected to the I2C bus, the data bus, or the battery.

11. The device of claim 1 wherein the SMD component further includes additional external pads dedicated to physically connect the SMD component to the PCB.

12. The device of claim 1, wherein the multilayer inductive coil is completely embedded within the multilayer surface mount structure.

13. A device comprising:

a surface mount device (SMD) component for surface mounting to a surface of a printed circuit board, the SMD component including a multilayer surface mount structure of dielectric layers that are laminated together and an RFID (Radio Frequency Identification) integrated circuit embedded within the multilayer surface mount structure between dielectric layers that are laminated together and electrically coupled to a first end and to a second end of a multilayer inductive coil at respective pads of the RFID integrated circuit, wherein the RFID integrated circuit is embedded between a first dielectric layer that is laminated together to a second dielectric layer, the multilayer inductive coil including a plurality of traces that are vertically distributed within the multilayer surface mount structure between dielectric layers that are laminated together above and below the embedded RFID integrated circuit to form a multilayer inductive coil for the RFID integrated circuit, wherein the plurality of traces above and below the embedded RFID integrated circuit and the metalized vias form an uninterrupted conductive path that travels above and below the embedded RFID integrated circuit from the first end to the second end of the multilayer inductive coil;

the SMD component further including:

first, second, third, and fourth external pads on a bottom surface of the SMD component:

the first and second external pads for connection to one of an inter-integrated circuit (I2C) bus and a data bus;

two internal microvias that electrically connect pads on the RFID integrated circuit to the first and second external pads;

the third and fourth external pads for connection to an external antenna; and two internal microvias that electrically connect pads on the RFID integrated circuit to the third and fourth external pads.

14. The device of claim 13 further comprising a printed circuit board (PCB), wherein the SMD component is mounted to the PCB.

15. The device of claim 14 wherein the SMD component further includes additional external pads on the bottom surface dedicated to physically connect the SMD component to the PCB.

16. The device of claim 13, wherein the multilayer inductive coil is completely embedded within the multilayer surface mount structure.

17. A device comprising:

a surface mount device (SMD) component for surface mounting to a surface of a printed circuit board (PCB), the SMD component including a multilayer surface mount structure of dielectric layers that are laminated together and an RFID (Radio Frequency Identification) integrated circuit embedded within the multilayer surface mount structure between dielectric layers that are laminated together and electrically coupled to a first end and to a second end of a multilayer inductive coil at respective pads of the RFID integrated circuit, wherein the RFID integrated circuit is embedded between a first dielectric layer that is laminated together to a second dielectric layer, the multilayer inductive coil including a plurality of traces that are vertically distributed within the multilayer surface mount structure between dielectric layers that are laminated together above and below the embedded RFID integrated circuit and electrically coupled together vertically by metalized vias to form the multilayer inductive coil for the RFID integrated circuit, wherein the plurality of traces above and below the embedded RFID integrated circuit and the metalized vias form an uninterrupted conductive path that travels above and below the embedded RFID integrated circuit from the first end to the second end of the multilayer inductive coil.

18. The device of claim 17, wherein the multilayer inductive coil is completely embedded within the multilayer surface mount structure.

* * * * *